United States Patent [19]

Endo et al.

[11] Patent Number: 4,633,139

[45] Date of Patent: Dec. 30, 1986

[54] PLASMA DISPLAY SYSTEM

[75] Inventors: Joichi Endo; Takashi Komatsu; Toshio Tohkura, all of Tokyo, Japan

[73] Assignee: OKI Electric Industry Co., Ltd., Tokyo, Japan

[21] Appl. No.: 666,338

[22] Filed: Oct. 30, 1984

[30] Foreign Application Priority Data

Nov. 8, 1983 [JP] Japan ..... 58-208354

[51] Int. Cl.[4] ..... G09G 3/10

[52] U.S. Cl. ..... 315/169.4; 315/169.1; 315/169.2; 315/169.3; 340/776; 340/789

[58] Field of Search ..... 315/169.4, 169.2, 169.1, 315/169.3; 340/776, 789, 768; 313/169, 584

[56] References Cited

U.S. PATENT DOCUMENTS

| | | | |
|---|---|---|---|
| 3,619,698 | 11/1971 | Caras | 315/169.4 |
| 3,626,235 | 12/1971 | Kupsky | 315/169.4 |
| 3,626,245 | 12/1971 | Rosenberg | 340/768 |
| 4,278,918 | 7/1981 | Bachofer | 315/169.4 |
| 4,326,148 | 4/1982 | Okamoto et al. | 315/169.4 |
| 4,349,816 | 9/1982 | Miller et al. | 315/169.3 |
| 4,373,157 | 2/1983 | Holz et al. | 315/169.4 |
| 4,459,514 | 7/1984 | Morimoto et al. | 315/169.3 |

*Primary Examiner*—David K. Moore
*Assistant Examiner*—M. Razavi
*Attorney, Agent, or Firm*—Ratner & Prestia

[57] ABSTRACT

A plasma display panel with quick firing nature and high speed scanning having a plurality of display cells defined by parallel cathode electrodes and parallel anode electrodes perpendicular to said cathode electrodes. The cells along a cathode electrode discharge simultaneously either strongly or weakly according to the currents in the anode electrodes, and said current in the anode electrodes is switched according to the picture pattern to be displayed. A strongly discharged cell provides a bright large discharge which is visible through a cathode electrode, and a weakly discharged cell provides a dark small discharge which is blinded by a cathode electrode itself and is invisible, but merely functions as a seed cell for firing adjacent cells. As all the cells function both as display cells and seed cells, quick firing of cells or high speed scanning of light spots along the anode electrodes is accomplished although no specific seed electrode for mere seed discharge is provided. And, density of cells or resolution power of a picture of the present invention is improved, as no specific seed electrode is provided.

5 Claims, 9 Drawing Figures

PLASMA DISPLAY SYSTEM

BACKGROUND OF THE INVENTION

The present invention relates to a gaseous discharge plasma display panel, which providss a flat and thin display screen. In particular, the present invention relates to such a panel which provides a high density of display cells for excellent picture quality, and high speed scanning operation.

In a conventional matrix type plasma display panel, a plurality of row electrodes and a plurality of column electrodes are arranged so that they cross perpendicular to one another to provide a display cell at each cross point. Upon applying potential between electrodes, the cell defined by the electrodes with the potential discharges and glows to display a bright dot of a character or a picture pattern. A display is accomplished through conventional scanning technique. There have been known two kinds of plasma display panels, an AC (alternate current) type, and DC (direct current), type. In the former type plasma display panel, the electrodes are covered with the dielectric layer, and a cell is energized by AC current. The AC type plasma display panel has the feature that a cell itself memorizes an indication information and so no external refresh memory is requested. In the latter DC type plasma display panel, the electrodes are disposed directly in a gaseous atmosphere without dielectric cover, and is energized by DC current. Although a DC type plasma display panel must have an external refresh memory, it has the advantage that an external circuit for operating the panel may be small and simple as compared with that of an AC type panel. The present invention relates in particular to a DC type plasma display panel.

One of the requests for a plasma display panel is high scanning speed, or quick firing of a discharge cell of a panel. That high speed scanning operation is essential in particular when there are provided a plenty of cells and a field frequency (refresh frequency) is high.

A prior art for quick firing of a cell for a DC type plasma display panel has been shown in U.S. Pat. No. 3,644,925, which has auxiliary speed cells in a panel. The seed cell glows continuously at a low level, not for viewing, but to provide excited particles for firing the indication cells. Due to the presence of ions or excited particles in gaseous cells, a quick firing of a cell which is located close to a seed cell is accomplished. In a practical structure for high speed scanning operation panel, the seed cells and the indication cells are positioned alternately so that any indication cell or display cell has an adjacent seed cell which provides excited ions or particles for firing said indication cell.

The prior plasma display panel with the seed cells and its operation are described in accordance with FIGS. 1A through 1D for the sake of the easy understanding of the present invention.

FIG. 1A is a cross section of the prior plasma display panel, FIG. 1B is the cross section at the line A—A of FIG. 1A, FIG. 1C shows the circuit diagram for operating the plasma display panel of FIG. 1A, and FIG. 1D shows operational waveforms in the circuit of FIG. 1C.

In FIGS. 1A and 1B, a plurality of parallel column display electrodes 1 and a plurality of auxiliary seed electrodes 2 are mounted in elongated ditches provided on a back support panel 3. A plurality of row electrodes 4 are positioned perpendicular to those column electrodes 1 and those seed electrodes 2. A transparent cover glass 6 covers all the electrodes. The cover glass 6 has elongated ditches 5 which provide a discharge space, and opaque black blind portion 7 along the seed electrodes 2. The column electrode 1 is called an anode electrode, and the row electrode 2 is called a cathode electrode, since the former is coupled with an anode of a power source, and the latter is coupled with a cathode of a power source.

In FIG. 1C, the anode electrodes ($Y_1$, $Y_2$, $Y_3$) and the seed electrodes ($S_1$, $S_2$) are positioned alternately so that they are perpendicular to the cathode electrodes ($X_1$, $X_2$, $X_3$). The cathode electrodes ($X_1$, $X_2$, $X_3$) are supplied either the ground potential or the predetermined potential $V_b$ through the switches ($SX_1$, $SX_2$, $SX_3$) which are controlled by the output of the decoder. The decoder receives the output of the counter which receives a clock pulse, and provides the control signals ($T_{x1}$, $T_{x2}$, $T_{x3}$) alternately to said switches. When the control signal ($T_{x1}$, $T_{x2}$, $T_{x3}$) is active, the related cathode electrode ($X_1$, $X_2$, $X_3$) is grounded. The anode electrodes ($Y_1$, $Y_2$, $Y_3$) are coupled with the power source $V_a$ through the resistors $R_1$, and the junction point of said resistor $R_1$ and the anode electrode is grounded through a resistor $R_2$ and a switch ($SY_1$, $SY_2$, $SY_3$) controlled by pattern data through the buffer circuit. When the switch ($SY_1$, $SY_2$, $SY_3$) is open, the potential of the anode electrode is $V_a$ (high potential), while the switch ($SY_1$, $SY_2$, $SY_3$) is closed, the potential of the anode electrode is low potential which is defined by the resistors $R_1$ and $R_2$. A cell discharges and glows only when the related anode electrode is on high potential $V_a$, and the related cathode electrode is grounded. The seed electrodes ($S_1$, $S_2$) are coupled with the potential $V_a$ through the resistor $R_1$, therefore, those seed electrodes have the potential $V_a$ irrespective of pattern data.

FIG. 1D shows operational time sequence of the circuit of FIG. 1C, where it is assumed that each frame period has three timing clock durations ($t_0$, $t_1$, $t_2$). The cathode electrodes ($X_1$, $X_2$, $X_3$) are provided the potential ($V_{x1}$,$V_{x2}$, $V_{x3}$), which is grounded alternately as shown by the shaded area in FIG. 1D. On the other hand, since the seed electrodes ($S_1$, $S_2$) always provide the high voltage $V_a$ through the resistors $R_1$, the seed current ($I_{s1}$, $I_{s2}$) flows continuously as shown in FIG. 1D. That is to say, when the first cathode electrode $X_1$ is grounded, the cell ($X_1-S_1$) between the cathode electrode $X_1$ and the seed electrode $S_1$ is active, and the current flows through that cell. Similarly, the seed cell ($X_1-S_2$) is active. Next, when the second cathode electrode $X_2$ is grounded at the timing $t_1$, the cells ($X_2-S_1$) and ($X_2-S_2$) are active. Similarly, when the third cathode electrode $X_3$ is grounded, the seed cells ($X_3-S_1$) and ($X_3-S_2$) are active.

At the clock timing $t_0$, the anode electrode $Y_2$ is at high voltage, and other anode electrodes $Y_1$ and $Y_3$ are at low voltage. Therefore, only the cell ($X_1-Y_1$) glows. It should be appreciated in that case that the seed cells ($X_1-S_1$) and ($X_2-S_2$) are active at the clock timing $t_0$, and there are many ions on charged particles near those active seed cells. Therefore, when the firing potential is applied to the display cell ($X_1-Y_2$), said cell fires quickly by the seed effect of the adjacent low glowing seed cells.

At the clock timing $t_1$, the seed cells ($X_1-S_1$) and ($X_1-S_2$) stop, but remain many charged ions near those cells. Therefore, when the potential is applied to the seed cells ($X_2-S_1$) and ($X_2-S_2$) which is located close to said seed cells ($X_1-S_1$) and ($X_1-S_2$), those seed cells ($X_2-S_1$) and ($X_2-S_2$) fire quickly at the clock timing $t_1$. Similarly, the display cells ($X_2-Y_1$) and ($X_2-Y_2$) fire quickly by the seed effect of the seed cells. Similarly, at the clock timing $t_2$, the seed cells ($X_3-S_1$) and ($X_3-S_2$), and the display cell ($X_3-Y_3$) fire. Of course, the bright display cells are determined by the pattern data applied to the anode electrodes.

Accordingly, it should be appreciated that the discharge of a seed cell shifts along a seed electrode, and similary, the discharge of a display cell shifts along an anode electrode. A display cell is fired quickly due to the presence of a seed cell.

However, the prior plasma display panel as described has the disadvantage due to the presence of the seed electrodes that the density of the display cells can not be high enough for high picture quality with high resolution power. It should be noted that the space between the electrodes is restricted by the manufacturing process. So, if there were no seed electrode, the space between the anode electrodes would be halved, or the density of the anode electrodes would be doubled.

SUMMARY OF THE INVENTION

It is an object, therefore, of the present invention to overcome the disadvantages and limitations of a prior plasma display panel by providing a new and improved plasma display panel.

It is also an object of the present invention to provide a plasma display panel which has high density of cells for high resolution power and excellent picture quality, and quick firing characteristics.

The above and other objects are attained by a plasma display panel comprising a flat display panel comprising a plurality of parallel cathode electrodes and a plurality of parallel anode electrodes positioned perpendicular to said cathode electrodes disposed in a gas-filled space sealed by a back plate and a transparent front plate, cross point between each of said cathode electrodes and each of said anode electrodes defining a discharge cell, an optical light by discharge being visibile through said transparent front plate and said cathode electrodes; a switching circuit having a first group of switches for supplying potential to said cathode electrodes and a second group of switches for switching discharge current in said anode electrodes; said first group of switches supplying one of first potential which is enough for discharge and second potential which is insufficient to discharge to said cathode electrodes so that only one cathode electrode receives the first potential and other cathode electrodes receive the second potential, and the cathode electrode with the first potential being scanned sequentially; said second group of switches supplying anode electrodes one of first current which is enough to provide visible optical light through the cathode electrodes and second current which is lower than said first current but is enough to discharge, when the related cathode electrode is at said first potential; wherein the cells along a cathode electrode which is at first potential discharges according to the picture pattern data, and provides excited seed particles for firing adjacent cells.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1A:
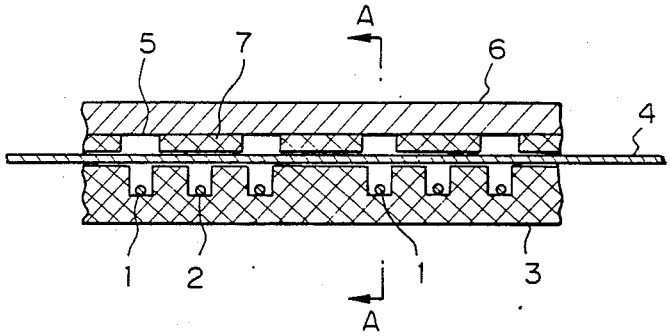
Fig. 1A PRIOR ART
FIG. 1A is a cross section of a prior plasma display panel.
Figure 1B:
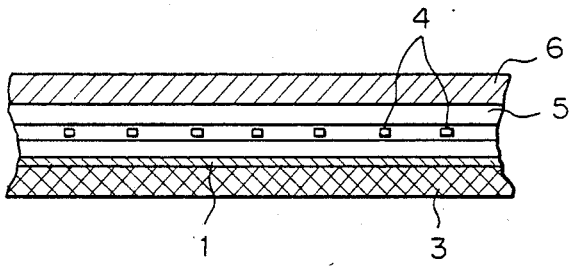
Fig. 1B PRIOR ART
FIG. 1B is a cross section at the line A—A of FIG. 1A.
Figure 1C:
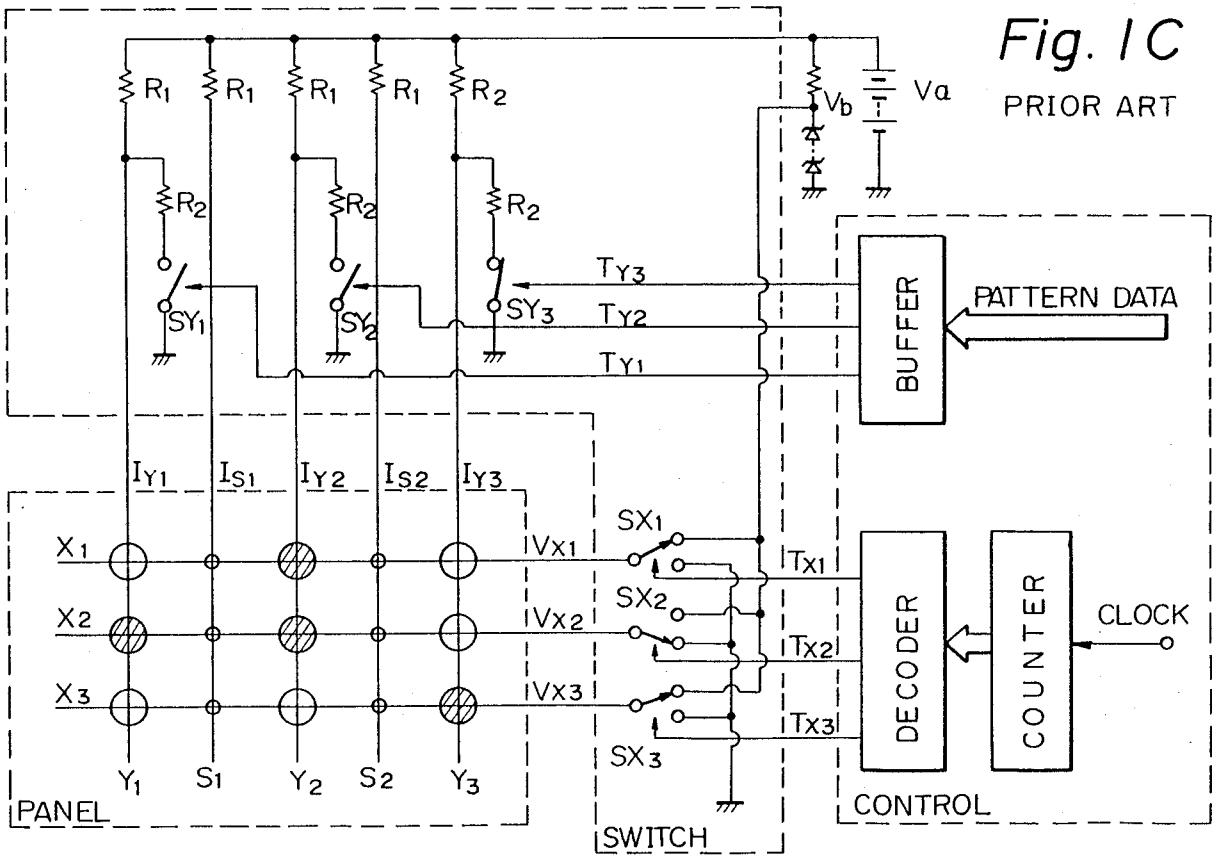
Fig. 1C PRIOR ART
FIG. 1C is a circuit diagram for operating the plasma display panel of FIG. 1A.
Figure 1D:
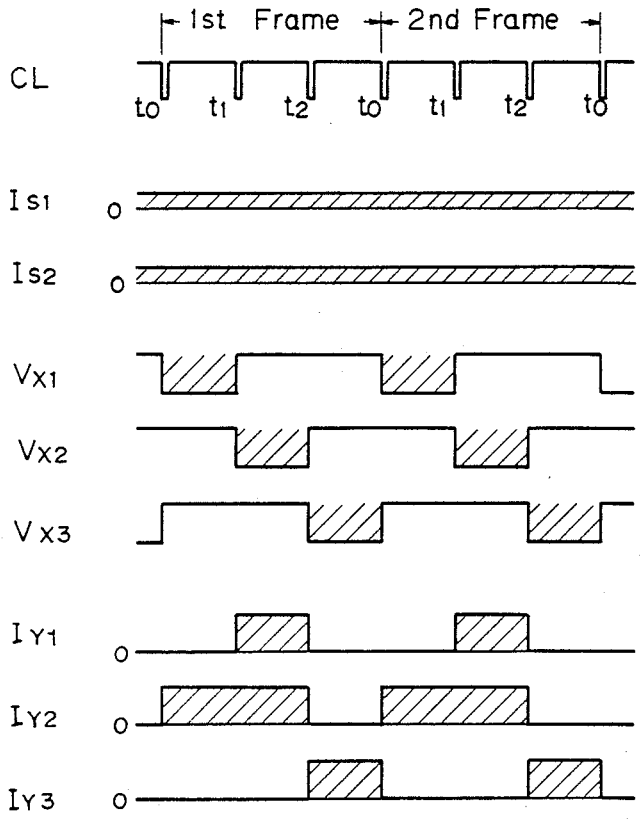
Fig. 1D PRIOR ART
FIG. 1D shows the operational timing sequence of the circuit of FIG. 1C.
Figure 2A:
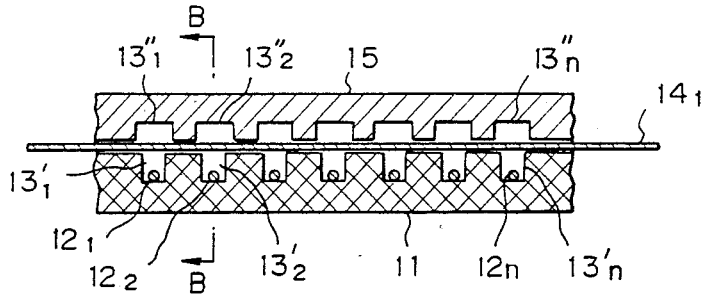
FIG. 2A is a cross section of the plasma display panel according to the present invention.
Figure 2B:
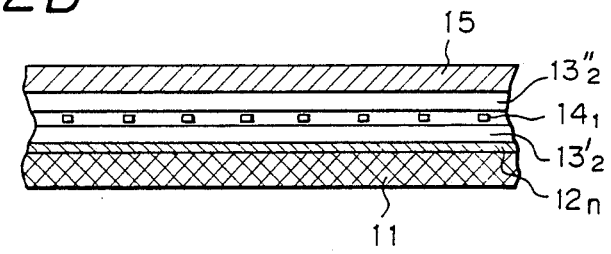
FIG. 2B is the cross section at the line B—B of FIG. 2A.
Figure 2C:
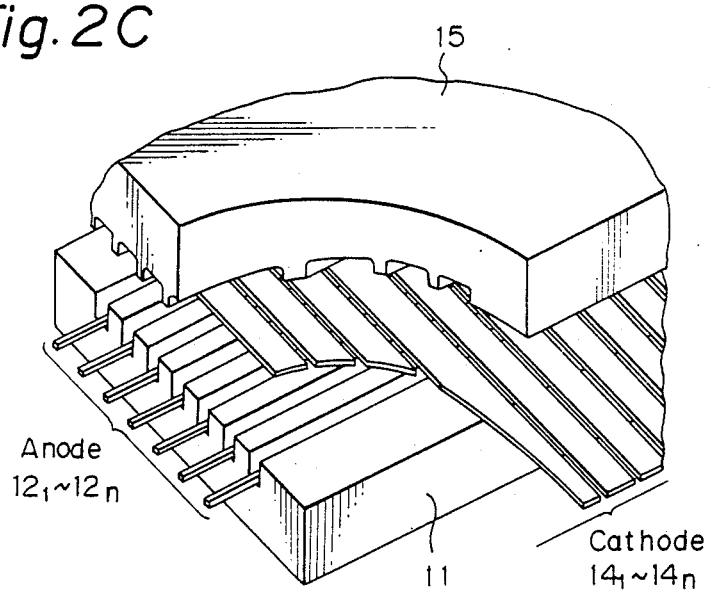
FIG. 2C is the perspective view of the plasma display panel of FIG. 2A.
Figure 2D:
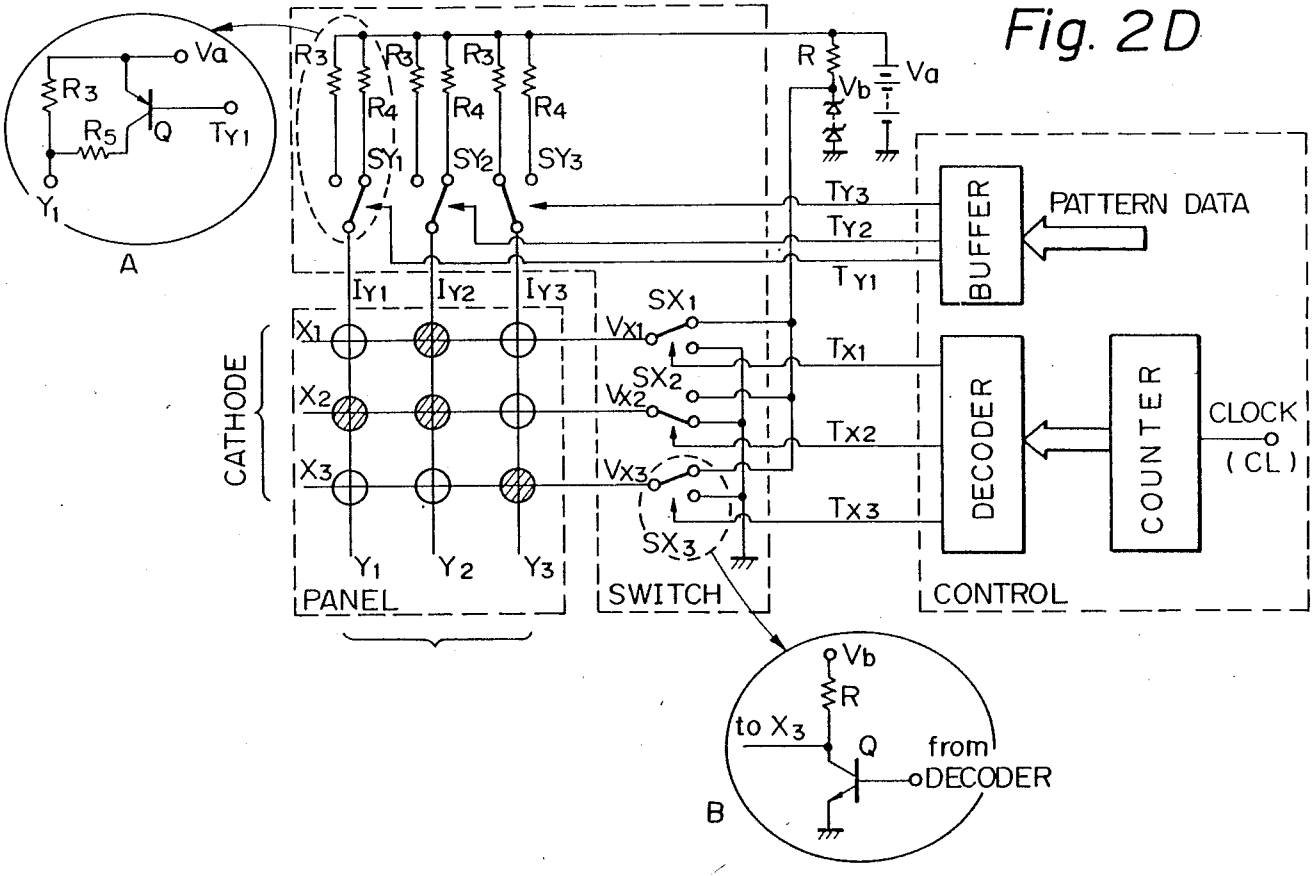
FIG. 2D is the circuit diagram for operating the plasma display panel according to the present invention.
Figure 2E:
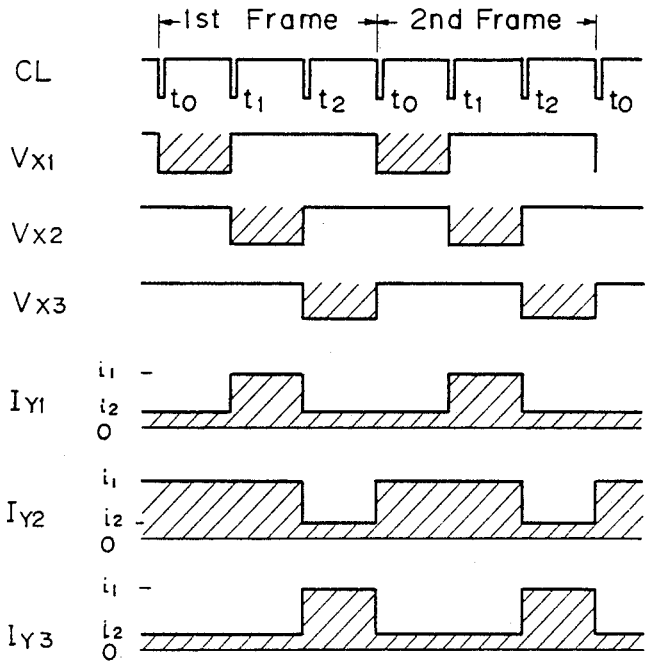
FIG. 2E shows operational timing sequence of the circuit of FIG. 2D.

FIG. 2A is a cross section of the plasma display panel according to the present invention, FIG. 2B is the cross section at the line B—B of FIG. 2A, FIG. 2C is the partially fragmental perspective view of the present plasma display panel, FIG. 2D shows the circuit diagram for operation of the present plasma display panel, and FIG. 2E shows operational timing sequence of the circuit of FIG. 2D.

In those figures, a plurality of parallel column electrodes $12_l$ through $12_n$, which are called anode electrodes, are mounted in elongated ditches provided on the back support plate 11. A plurality of row electrodes $14_l$ through $14_n$ are positioned perpendicular to those column electrodes. Those row electrodes are called cathode electrodes, since they are coupled with a cathode electrode of a power source. Preferably, the cross section of each cathode electrode is in rectangular shape. The transparent cover glass plate 15 covers all the electrodes. The cover glass 15 has a plurality of elongated parallel ditches $13''_l$ through $13''_n$ which provide a discharge space for the discharge cells. The ditches $13'_l$ through $13'_n$ which mount anode electrodes $12_l$ through $12_n$ also provide a discharge space. Those discharge spaces are filled with discharge gas, for instance, neon or argon. A small quantity of mercury gas is also filled in the discharge spaces for preventing damage of the cathode electrodes by cathode-sputtering.

It should be noted in those figures that no seed electrodes is provided, and it is the feature of the present invention that a prior seed electrode is omitted while keeping high scanning speed or quick firing. Due to the deletion of a prior seed electrode, the density of display electrodes in the present plasma display panel has been improved. In other words, a seed discharge is effected by a display cell itself in the present invention. An optical light by a seed discharge is hidden by a cathode electrode which has preferably a rectangular cross section, therefore, said light by seed discharge is unvisible.

FIG. 2D shows the circuit diagram for operating the present plasma display panel, and FIG. 2E shows the timing sequence of the typical signals in the circuit of FIG. 2D. In FIG. 2D, the anode electrodes ($Y_1$, $Y_2$, $Y_3$) are positioned perpendicular to the cathode electrodes ($X_1$, $X_2$, $X_3$). The cathode electrodes ($X_1$, $X_2$, $X_3$) are supplied either the ground potential or the predetermined potential $V_b$ through the switches ($SX_1$, $SX_2$, $SX_3$) which are controlled by the output of the decoder. The decoder receives the output of the counter which receives a clock pulse CL, and said decoder applies the control signals ($T_{x1}$, $T_{x2}$, $T_{x3}$) alternately to said switches. When the control signal ($T_{x1}$, $T_{x2}$, $T_{x3}$) is active, the related cathode electrode ($X_1$, $X_2$, or $X_3$) is grounded, and when said control signal is inactive, the related cathode electrode receives the potential $V_b$ which is lower than the source potential $V_a$. The andoe electrodes ($Y_1$, $Y_2$, $Y_3$) are coupled with the power source $V_a$ through the switches ($SY_1$, $SY_2$, $SY_3$) and one of the resistors $R_3$ and $R_4$. It is supposed that the resistance of the resistor $R_3$ is higher than that of $R_4$. The resistor $R_3$ is for seed discharge, and is preferably 500 kilo-ohms, and the resistor $R_4$ is for display discharge and is preferably 50 kilo-ohms.

The structure of the switch ($SY_1$, $SY_2$, or $SY_3$) and the resistors $R_3$ and $R_4$ is shown in the circle A, in which the switch is implemented by the transistor Q. When the control signal $T_{y1}$ applied to the base electrode of the transistor Q is inactive, the transistor Q is in OFF state, and then, the anode electrode $Y_1$ is supplied with the power potential $V_a$ through the high resistor $R_3$. On the other hand, when the control signal $T_{y1}$ is active, the transistor Q is in ON stae, then, the resistors $R_3$ and $R_5$ are coupled parallel with each other. The resistance of that parallel circuit is substantially the same as the resistance of $R_4$. Accordingly, the anode electrode $Y_1$ is essentially coupled with the power potential $V_a$ through the resistor $R_4$.

The control signals $T_{y1}$, $T_{y2}$, and $T_{y3}$ for controlling the switches ($SY_1$, $SY_2$, $SY_3$) are supplied according to the pattern data to be displayed through the buffer circuit.

The structure of the switch ($SX_1$, $SX_2$, $SX_3$) is shwon in the circle B, in which the switch is implemented by the transistor Q. When the base electrode of the transistor Q is inactive, the transistor is in OFF state, and therefore, the related cathode electrode is coupled with the potential $V_b$ which is lower than the potential $V_a$ through the resistor R. When the base electrode of the transistor Q is in OFF state, the related cathode electrode does not discharge. On the other hand, when the base electrode of the transistor Q is active, the transistor Q is in ON state, and the collector of the same is substantially grounded, and then, the related cathode electrode is grounded. The related cathode electrode discharges in this state. Thus, the transistor Q switches the potential of the related cathode electrode between the first potential (ground potential) and the second potential (potential $V_b$).

Each cell of the panel has two discharge modes, a seed discharge mode, and a display discharge mode. When a cathode electrode is grounded, and an anode electrode is coupled with the power potential $V_a$ through the lower resistor $R_4$, the cell defined by the cross point between said cathode electrode and said anode electrode discharges strongly, and the visible discharge is for display. On the other hand, when a cathode electrode is grounded, and an anode electrode is coupled with the power potential through the high resistor $R_3$, the cell discharges weakly, and the weak discharge is not visible, since the discharge light is shadowed or covered by the cathode electrode itself. That weak discharge is used as a seed discharge. When a cathode electrode is coupled with the low potential $V_b$ through the switch ($SX_1$, $SX_2$, or $SX_3$), the related cell does not discharge irrespective of the potential of the related anode electrode. Said strong discharge for display purpose is called a first mode discharge, and said weak discharge for a seed purpose is called a second mode discharge.

FIG. 2E shows operational time sequence of the circuit of FIG. 2D, where it is assumed that each frame period has three timing clock durations ($t_0$, $t_1$, $t_2$). The cathode electrodes ($X_1$, $X_2$, $X_3$) are provided the potential ($V_{x1}$, $V_{x2}$, $V_{x3}$), which is grounded alternately as shown by the shaded area in FIG. 2E.

During the time $t_0$ and the time $t_1$, the control potential $V_{x1}$ is grounded, therefore the cathode electrode $X_1$ is grounded. The cells ($X_1-Y_1$, $X_1-Y_2$, $X_1-Y_3$) which relate to the first cathode electrode $X_1$ discharge at least weakly. And, if some anode electrodes are switched to the lower resistors, the cells defined by the first cathode electrode $X_1$ and said anode electrode with the low resistors discharge strongly for display purposes. In the example of FIG. 2E, it is assumed that the anode electrodes $Y_1$ and $Y_3$ are coupled with the high resistors $R_3$, and the second anode electrode $Y_2$ is coupled with the low resistor $R_4$. Therefore, the current $I_{y1}$ and $I_{y3}$ in the first and the third anode electrodes $Y_1$ and $Y_3$ is small level $i_2$ (for instance $i_2=100$–$200\ \mu A$), and the current $I_{y2}$ in the second anode electrode $Y_2$ is high level $i_1$ (for instance, $i_1$ is higher than $600\ \mu A$ and preferably $i_1=800\ \mu A$). Accordingly, the cells ($X_1-Y_1$ and $X_1-Y_3$) discharge weakly, and the cell ($X_1-Y_2$) discharge strongly.

During the time $t_1$ and $t_2$, the control potential $V_{x1}$ is coupled with the potential $V_b$, and the control potential $V_{x2}$ is grounded. Therefore, the cells relating to the cathode electrode $X_1$ stop the discharge, and the cells ($X_2-Y_1$, $X_2-Y_2$, $X_2-Y_3$) relating to the second cathode electrode $X_2$ discharges eigther weakly or strongly. In the embodiment of FIG. 2E, the current $I_{y1}$, and the current $I_{y2}$ are at high level, and therefore, the cells ($X_2-Y_1$ and $X_2-y_2$) discharge strongly for display purposes, and the cell ($X_2-Y_3$) discharge weakly as a seed cell. In the transfer of the discharge from the first cathode electrode $X_1$ to the second cathode electrode $X_2$ along the anode electrodes, it should be appreciated that the charged ions around the first cathode $X_1$ function as seeds for firing the cells on the second cathode electrode $X_2$. Therefore, the firing of a new cell is accomplished in a very short time, due to the seed effect of the previously discharged cells, although no specific seed electrode is provided.

During the time $t_2$ and $t_0$, the discharge along the second cathode electrode $X_2$ transfers to the third cathode electrode $X_3$. Therefore, the discharge scans along the anode electrodes. In the embodiment of FIG. 2E, the current $I_{y3}$ is high, so, the cell ($X_3-Y_3$) is bright, and other cells ($X_3-Y_1$ and $X_3-Y_2$) are dark.

The above operations are repeated by transferring the dischage cell along the anode electrodes. Accordingly, in the embodiment of FIGS. 2D and 2E, the cells ($X_1-Y_2$, $X_2-Y_1$, $X_2-Y_2$, and $X_3-Y_3$) are bright and discharge strongly for the display purposes as shown by the shaded dots in FIG. 2D, and other cells discharge weakly merely for seed purposes.

As for the first cachode electrode which locates at the extreme end of the panel, there is no seed in the circuit of FIG. 2D, and it takes long time for firing the first cathode cells. In order to solve this problem, the first clock duration might be longer than other clock durations. Alternatively, the clock durations are uniform, and additional hidden seed electrode as described in the U.S. Pat. No. 3,644,925 might be provided near the first cathode electrode $X_1$.

The typical numerical examples of the embodiment are enumerated below.

The source voltage $V_a$; 185 volts
The divided voltage $V_b$; 80 volts
The resistance of the resistor $R_3$; 500 kilo-ohms
The resistance of the resistor $R_4$; 50 kilo-ohms
The display current $i_1$; 800 μA
The seed current $i_2$; 200 μA
The space between the anode electrodes $12_l$–$12_n$; 1.27 mm
The width of each ditches $13'_l$–$13'_n$; 0.3 mm
The depth of each ditches $13'_l$–$13'_n$; 0.5 mm
The space between the cathode electrodes 14; 1.27 mm
The width of the cathode electrode 14; 0.8 mm
The thickness of the cathode electrode; 0.075 mm The above figures are merely example, and of course other numerical embodiments are possible. For instance, the period or the pitch of the cathode electrodes and the anode electrodes less than 0.6 mm is possible.

As described above in detail, the present plasma display panel has no specific seed electrode, and all the electrodes and the cells defined by said electrodes are used as display cells. Therefore, the density of the cells, or the resolution power or the picture thus displayed is doubled as compared with that of a prior plasma display panel, and a fine picture is displayed. A quick firing or a high speed scanning of a prior plasma display panel which has a seed electrode is also obtained in the present invention. Since the present plasma display panel provides a visible pattern through the cathode electrodes, the seed discharge is not visible as the light by the seed discharge is hidden by the cathode electrodes. So, no cover for blinding a seed discharge light is necessary in the present invention.

From the foregoing, it will now be apparent that a new and improved plasma display panel has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A plasma display system comprising:

a flat display panel comprising a plurality of parallel cathode electrodes and a plurality of parallel anode electrodes positioned perpendicular to and crossing said cathode electrodes disposed in a gasfilled space sealed by a back plate and a transparent front plate, a crossing between each of said cathode electrodes and each of said anode electrodes defining a discharge cell, visible light produced by gaseous discharge at a crossing being visible through said transparent front plate and said cathode electrodes, a switching circuit having a first group of switches for supplying either one of two DC potentials to said cathode electrodes and a second group of switches for supplying either one of two DC currents to said anode electrodes, said first group of switches supplying either a first potential which is high enough to cause discharge of a second potential which is insufficient to cause discharge, only one cathode electrode at a time receiving said first potential, while other cathode electrodes receive said second potential, and said first potential being supplied sequentially to all said cathode electrodes, said second group of switches supplying either a first current which is high enough to provide strong visible discharge in a cell or a second current which is lower than said first current but is high enough to provide weak seed discharge, when the related crossing cathode electrode is at said first potential, wherein cells along a cathode electrode which is supplied with said first potential discharge to provide visible light at crossings with anode electrodes supplied with said first current according to picture pattern data, and discharge weakly at crossings with anode electrodes supplied with said second current to provide excited seed particles for firing adjacent cells, thereby avoiding the need for separate seed electrodes.

2. A plasma display system according to claim 1, wherein each of said second group of switches has a transistor switch for switching a pair of resistors between an anode electrode and a power source.

3. A plasma display system according to claim 2, wherein current in a cell when a first resistor is selected is in the range between 100 μA and 200 μA.

4. A plasma display system according to claim 2, wherein current in a cell when a second resistor is selected is larger than 600 μA.

5. A plasma display system according to claim 1, wherein cross section of each of said cathode electrodes is in rectangular shape for blinding seed discharge light.

* * * * *